US006264867B1

(12) United States Patent
Keenan

(10) Patent No.: US 6,264,867 B1
(45) Date of Patent: Jul. 24, 2001

(54) METHOD FOR MAKING A NOISE ABATEMENT WALL

(75) Inventor: Andrew J. Keenan, McHenry, IL (US)

(73) Assignee: Prestress Engineering Co., Inc., Prairie Grove, IL (US)

( * ) Notice: Subject to any disclaimer, the term of this patent is extended or adjusted under 35 U.S.C. 154(b) by 958 days.

(21) Appl. No.: 08/526,942

(22) Filed: Sep. 22, 1995

Related U.S. Application Data

(62) Division of application No. 08/323,882, filed on Oct. 17, 1994, now abandoned, which is a continuation of application No. 08/607,886, filed on Feb. 27, 1996, now Pat. No. 6,000,182.

(51) Int. Cl.[7] ..... B29C 33/40; B29C 39/10

(52) U.S. Cl. ..... 264/219; 264/263; 264/277; 264/278; 264/279; 264/279.1

(58) Field of Search ..... 264/219, 277, 264/278, 279, 279.1, 263

(56) References Cited

U.S. PATENT DOCUMENTS

| | | | | |
|---|---|---|---|---|
| 828,833 | * | 8/1906 | Atterburg | 264/277 X |
| 968,865 | * | 8/1910 | Matti | 52/592.1 X |
| 1,307,793 | * | 6/1919 | Schulz | 264/279 X |
| 1,389,803 | * | 9/1921 | Wolfe | 264/277 X |
| 1,598,131 | * | 8/1926 | Ham | 264/278 X |
| 2,082,399 | * | 6/1937 | Isman et al. | 264/279 X |
| 2,964,821 | * | 12/1960 | Meehan | 264/278 X |
| 3,307,822 | * | 3/1967 | Stout . | |
| 3,584,088 | * | 6/1971 | Williams . | |
| 3,743,232 | * | 7/1973 | Vaughan . | |
| 3,954,377 | * | 5/1976 | Scholz et al. . | |
| 4,111,410 | * | 9/1978 | Pickett | 52/223.7 X |
| 4,241,554 | * | 12/1980 | Infantino | 52/592.1 X |
| 4,290,246 | * | 9/1981 | Hilsey | 52/223.7 X |
| 4,694,624 | * | 9/1987 | Juhas | 52/223.7 |
| 4,769,191 | * | 9/1988 | Diana . | |
| 5,202,132 | * | 4/1993 | Myers et al. | 425/62 |
| 5,246,640 | * | 9/1993 | Bryant | 264/219 X |
| 5,353,560 | * | 10/1994 | Heydon | 52/592.1 X |
| 5,404,685 | * | 4/1995 | Collins | 52/309.7 |
| 5,524,405 | * | 6/1996 | Byrd | 52/295 |

* cited by examiner

*Primary Examiner*—Jan H. Silbaugh
(74) *Attorney, Agent, or Firm*—Mathew R. P. Perrone, Jr.

(57) ABSTRACT

A noise abatement wall is assembled from a plurality of vertically-cast wall sections, and mounted either on a wall or a plurality of caissons, in a tongue and groove type assembly.

8 Claims, 6 Drawing Sheets

METHOD FOR MAKING A NOISE ABATEMENT WALL

CROSS-REFERENCE TO RELATED APPLICATIONS

This application is a divisional application of U.S. patent application Ser. No. 08/323,882, filed Oct. 17, 1994, now abandoned, in favor of continuation U.S. patent application Ser. No. 08/607,886 filed Feb. 27, 1996, now U.S. Pat. No. 6,000,182.

BACKGROUND OF THE INVENTION

This invention relates to a noise abatement wall and more particularly to a noise abatement wall in the form of a precast, prestressed concrete sound wall capable of standing on its own while providing both aesthetically pleasing apperance and sound damping effect for noise created by traffic.

Roads, and especially interstate highways or tollways create a substantially amount of noise due to the high volume of traffic thereon. It is common for a residential community to be built close to such a road structure. It is also common for such a road structure to be built close to a prior existing residential community.

In the magazine entitled *Wall Journal* of September/October 1993, figures indicate that a heavy truck produces about ten times the noise energy of a passenger car. In other words, ten passenger cars produce the noise energy of one heavy truck. It is desired, and even required, to reduce this noise and provide for aesthetically pleasing comfort for nearby residential areas.

No matter how that proximity occurs, the noise from the road structure can easily disturb the tranquility of a community. It is desired to minimize the noise and disturbance to the community while maintaining the closeness of the road and the efficiency thereof. Such closeness of efficient travel to a community provides for more efficient transportation and greater use of assets. It also provides terrific environmental advantages for such actions, due to reduced travel time and efficient vehicle use among other reasons.

Unfortunately walls designed to decrease the noise have a tendency to be expensive without achieving the desired results of noise abatement. Typically, if such a wall is flat cast and moved into place, the wall must then be supported until it is cured. The support is a complicated, costly structure in order to stand vertically as required. The complicated wall support structure, not only adds to the expense, but detracts from the aesthetic qualities of the wall.

An attempt to cast the wall in place is inefficient because of the required molding and structure set up. Accordingly, it is desired to achieve the production of the walls in an efficient fashion while obtaining the desired results.

Added to that difficult combination is the requirement that the wall must reflect sound. If sound can be reflected away from an area, great advantages occur from the resulting relative reduction of noise in the area desired to be protected from that noise.

It is highly desirable that such a wall be simply and easily produced. That wall must also be both attractive and cost effective. This is a difficult combination of factors to achieve.

Further advantages are obtained if a noise abatement wall can be moved after installation. This movement, of course, is necessary when widening of the road is considered. If the walls can be moved and reused, great advantages are obtained in that savings become substantial in the construction of the highway widening project.

Typical surfaces desired for these panels or wall sections include rake, broom, or exposed aggregate. It is desired, however, to achieve a number of additional different surfaces. This requirement of different surfaces for different wall sections, and even for a different surface on each side of a panel thereof creates difficulty for the efficient formation of these surfaces. Not only must the mold be adjusted to form the desired surface, the mold must be adjusted efficiently and with minimal cost.

A noise abatement wall is also subject to high wind loads. The noise abatement wall must be supported sufficiently to withstand the windloads.

The size and weight of each individual wall section make the individual wall section difficult to ship and handle. Once each individual wall section is delivered to a desired site, it must be easily installed with other sections to form a wall.

SUMMARY OF THE INVENTION

Among the many objectives of this invention is the provision of a noise abatement wall molded vertically with a desired surface and assembly structure.

Another objective of this invention is to provide a noise abatement wall having a decorative surface.

Yet another objective of this invention is to provide a noise abatement wall having a noise abatement surface.

Still another objective of this invention is to provide a noise abatement wall, which is movable.

Additionally, an objective of this invention is to provide a method of vertically molding a noise abatement wall.

Also, an objective of this invention is to provide a method of assembly for a noise abatement wall.

A further objective of this invention is to provide a noise abatement wall, which is easily installed.

A still further objective of this invention is to provide a method for making noise abatement wall panel.

Yet a further objective of this invention is to provide a noise abatement wall having a noise reflecting surface.

Another objective of this invention is to provide a method for forming a noise abatement wall having from a series of wall sections.

Yet another objective of this invention is to provide a noise abatement wall having a high resistance to wind load.

Still another objective of this invention is to provide a noise abatement wall, which can be shipped and handled in a simpler fashion.

These and other objectives of the invention (which other objectives become clear by consideration of the specification, claims and drawings as a whole) are met by providing a noise abatement wall assembled from a plurality of vertically-cast wall sections, and mounted either on a wall or a plurality of caissons.

BRIEF DESCRIPTION OF DRAWINGS

Throughout the figures of the drawings where the same part appears in more than one figure the same number is applied thereto.

DESCRIPTION OF THE PREFERRED EMBODIMENTS

The concrete wall section of this invention is vertically cast in a dual sided steel mold. The mold has a changeable surface on each side thereof, to thereby form the proper texture on the shape of the wall, and in particular on the sides of each wall section. This mold is vertical in order to be filled from the top. With these forms on either side, the desired texture may be produced on the wall section. The texture may be the same or different on the various sides.

The texture of the panel may be very capable of reducing the noise on the side exposed to the toll road and very decorative on the side exposed to the residential area. The wall section includes a panel with a mounting block or mounting post at one end of the panel.

The mounting post includes a notch to receive the end of the panel on a wall section which is oppositely disposed from the mounting post. The width of the panel and the notch are coordinates so that one wall section may be used with the another wall section panel to notch system, in a fashion similar to a tongue and groove structure.

The post may be secured to a caisson which permits each panel to form part of the wall. The noise abatement wall is thus mounted easily and free standing. The vertical casting of the wall section permits the various textures to be employed on a panel.

It is also possible to secure each panel to an existing wall. The noise abatement wall is thus positioned without using a caisson for each panel. The mounting post and panel combination for the wall section are substantially co-planar. The notch in the panel receives the opposing end of the adjacent panel without any special structure being on the end of the panel. Another way of phrasing the reference to coplanar, is that, for each wall section, the notch and the panel are centered on opposite sides of the mounting post. This permit a tongue and groove assembly of a noise abatement wall.

The mounting post and panel combination for the wall section are substantially co-planar. The notch in the panel receives the opposing end of the adjacent panel without any special structure being on the end of the panel. Another way of phrasing the reference to coplanar, it that, for each wall section, the notch and the panel are centered on opposite sides of the mounting post. This permits a tongue and groove assembly of a noise abatement wall.

With the mounting post and panel combination for the wall section, the windload requirements can be met. While it is not desired to be bound by any particular theory, the notch with the securing of post is believed to provide the desired strength.

The mounting post has a width up to six times the width of the panel. More preferably, the mounting post has a width of one to five times the width of the panel. Most preferably, the mounting post has a width of three to five times the width of the panel.

Figure 1:
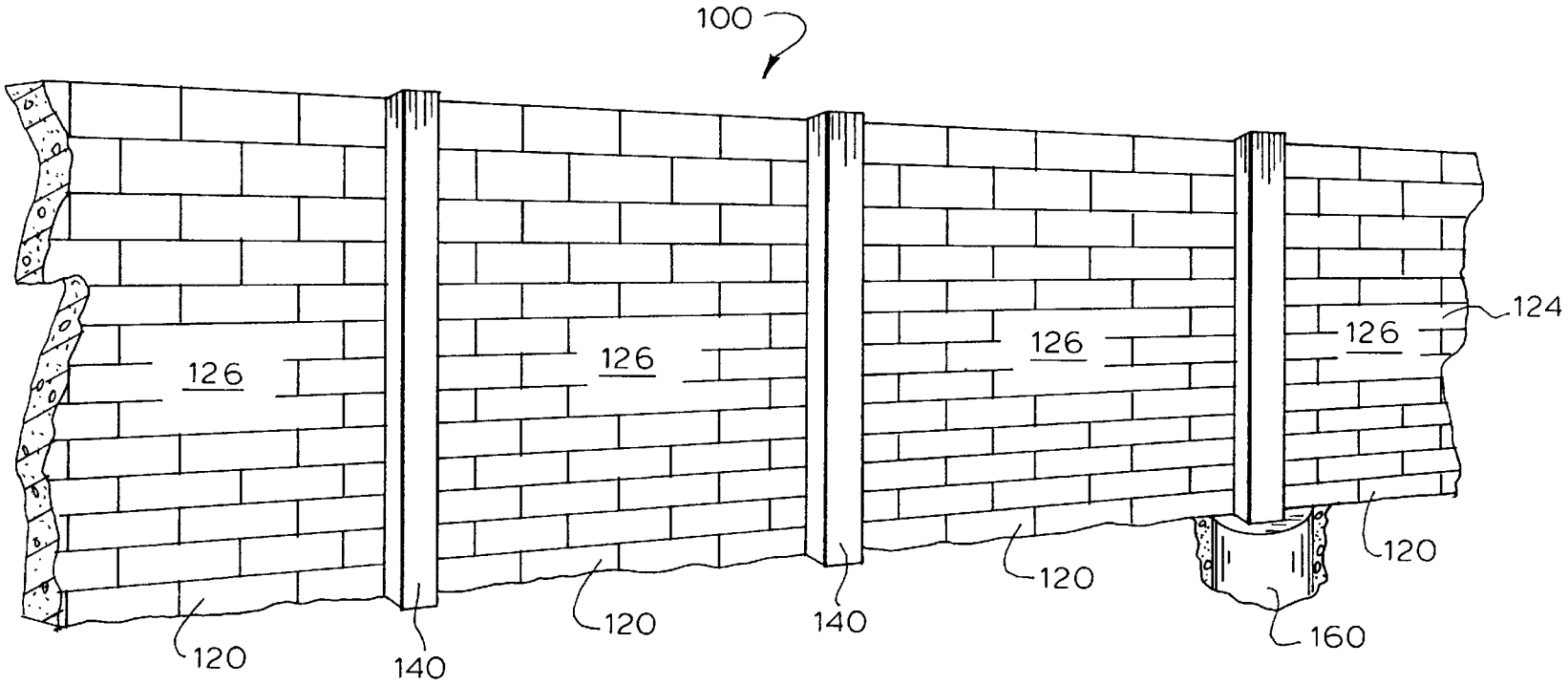
FIG. 1 depicts a perspective view of a noise abatement wall 100 formed from a plurality of wall sections 120 of this invention.

Referring now to FIG. 1, a series of panels or wall sections 120 combine to form a noise abatement wall 100. The panels may have any design 124 thereon. The design 124 may be acoustical or decorative in nature, or even a combination thereof. A different design 124 may be on opposite sides of wall section 120.

Figure 2:
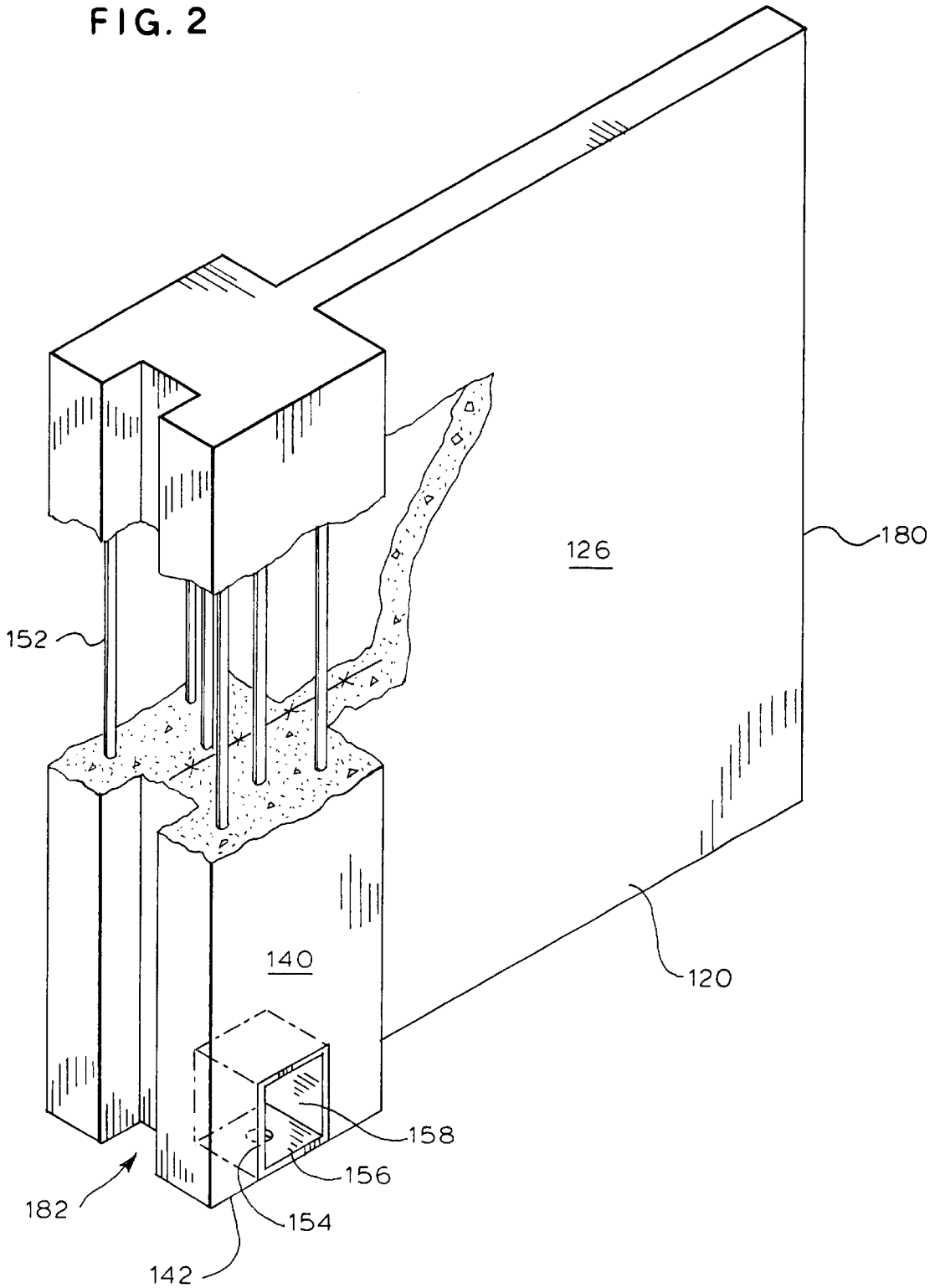
FIG. 2 depicts a perspective view of a single wall section 120 of this invention.

Referring now to FIG. 2, wall section 120 includes a panel 126 and a mounting block 140. Mounting block 140 serves to receive a wall panel 126 of an adjoining wall section 120. It is also possible to refer mounting block 140 as a mounting post. With a series of these wall sections 120 assembled as in FIG. 1, a noise abatement wall 100 is maintained.

Figure 3:
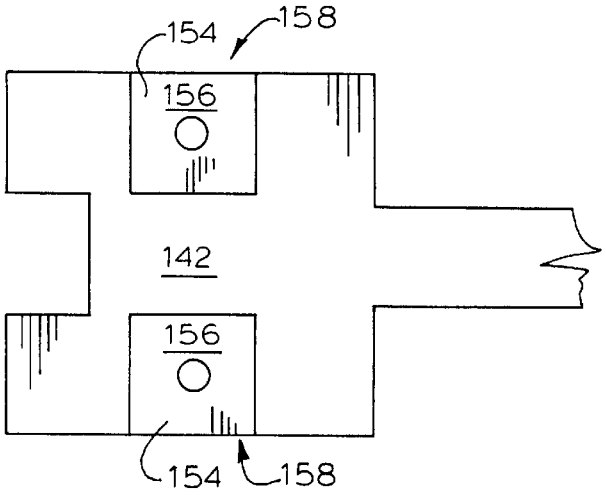
FIG. 3 depicts a bottom plan view and partial cross section of mounting block 140.

Adding FIG. 3 to the Consideration of FIG. 2, the base 142 of mounting block 140 is depicted showing various reinforcement rods 152 and a mounting bracket 154. Mounting bracket 154 includes a pair of apertured plates 156 mounted in gaps 158 in the base 142 of block 140.

These plates 156 can be secured to a caisson 160 in the ground 112 (FIG. 1 and FIG. 9) and thereby secure the wall section 120 in place. The caissons 160 are spaced sufficiently apart so that the wall panel 126 may be received in the block notch 182 of the block 140.

Figure 4:
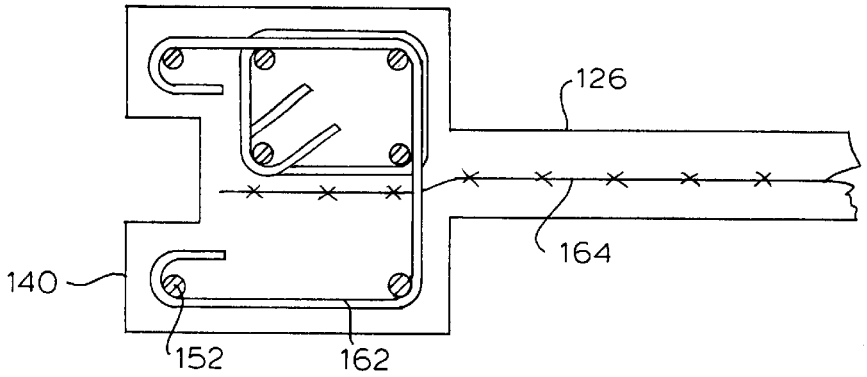
FIG. 4 depicts a top plan view and partial cross section of mounting block 140 and panel 126.

In FIG. 4, there are depicted reinforcement of the mounting block 140. There are various vertical reinforcement rods 152 and horizontal support rods 162 mounted therein during the course of molding process for the wall section 120. Extending from the mounting block 140 into the wall panel 126 is wire reinforcement 164.

Figure 5:
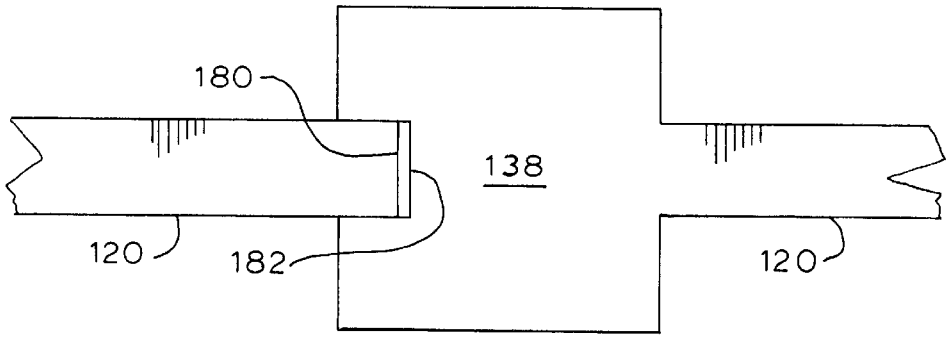
FIG. 5 depicts a top plan view of a first wall section 120 mated with a second wall section 120.

In FIG. 5 is the top view 138 shown in the mounting of a first wall section 120 into a second wall section 120. More specifically, the edge 180 of wall panel 126 fits into a notch 182 of mounting block 140. In this fashion, the base 142 of mounting block 140 being securely combined with the notch 182 provides for a structure of noise abatement wall 100.

FIG. 4 and FIG. 5 combine to show the co-planar characteristics of mounting block 140 and wall panel 126 in each wall section 120. Edge 180 of wall panel 126 of a first wall section 120 can fit into notch 182 of a second wall section 120. Wall panel 126 and edge 180 require no special structure for edge 180 and notch 182 to join.

Figure 6:
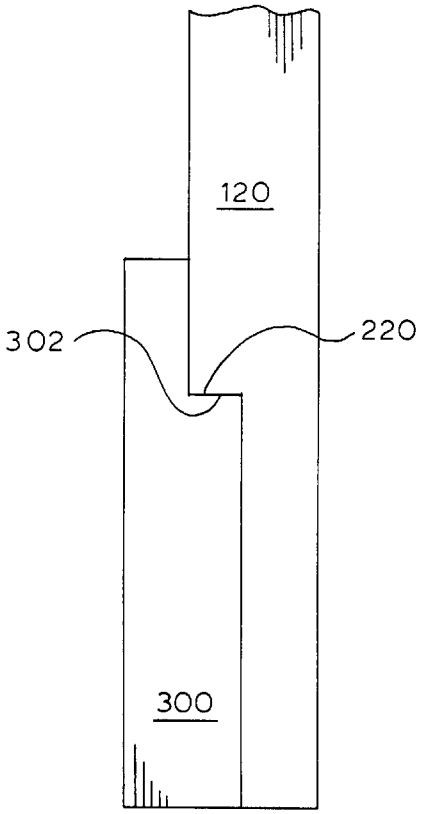
FIG. 6 depicts a side plan view of support or lower wall 300 receiving the noise abatement wall 100.
Figure 12:
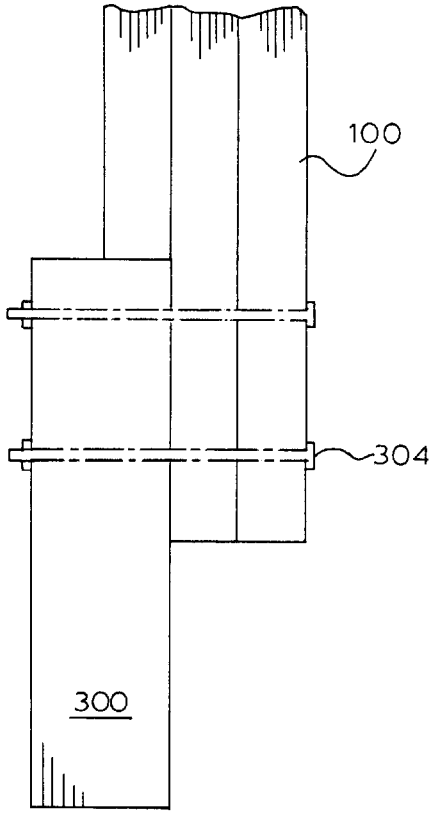
FIG. 12 depicts a side, partially sectioned view of wall section 120 mounted on lower wall 300.

Combining FIGS. 6 and 12, it may be seen how the wall 100 is mounted on an above ground structure. A flange 220 is molded into the wall section 120, and the flange 220 is supported on the lower wall 300 by a notch 302 in lower wall 300. This structure provides for mounting each wall section 120 on a portion of lower wall 300. This, of course, assumes that a wall such as lower wall 300 is both in place and has the desired strength for mounting a noise abatement wall 100 thereon.

Figure 7:
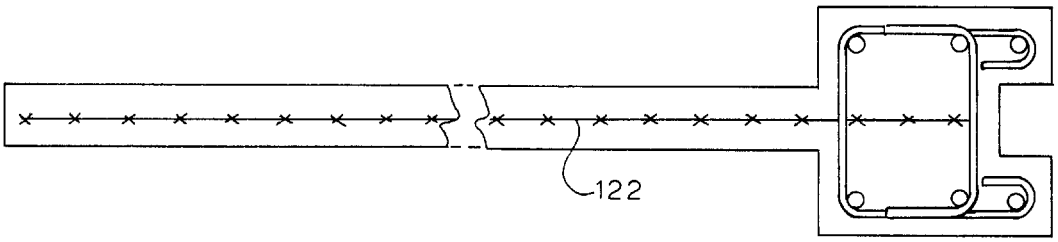
FIG. 7 depicts a top plan view of wall section 120 showing reinforcement wires 122 therein.

In FIG. 7, substantially, the full length of the wall section 120 is depicted. Various reinforcing wires are depicted therein. This discussion of FIG. 7 becomes clear when considered in combination with FIG. 4.

Figure 8:
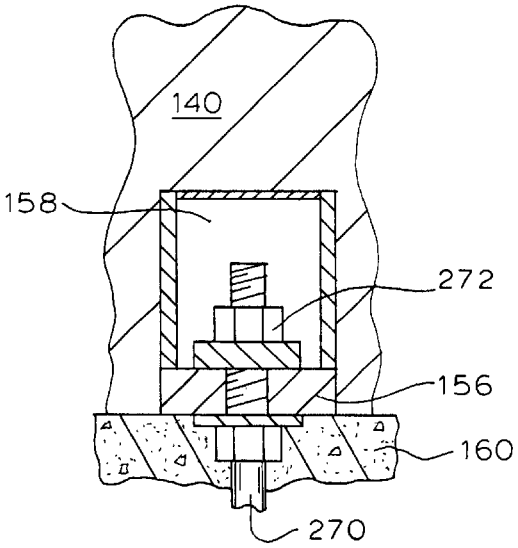
FIG. 8 depicts a side view and partial cross section of the mounting bracket 210 for wall section 120 to caisson 160.

In FIG. 8, the apertured plate 156 is shown as mounted on caisson bolts 270 by caisson nut 272. The caisson 160 is mounted in the ground 112 and supports the mounting block 140 in this fashion. With the apertured plate 156 mounted in the gaps 158, it becomes a simple matter to drop the plate 156 over the caisson bolt 270 and apply the nuts 272 thereto.

Figure 10:
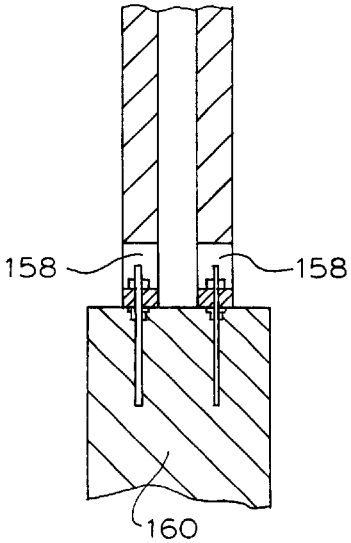
FIG. 10 depicts a side, partially sectioned view of mounting block 140 mounted on a caisson 160.
Figure 9:
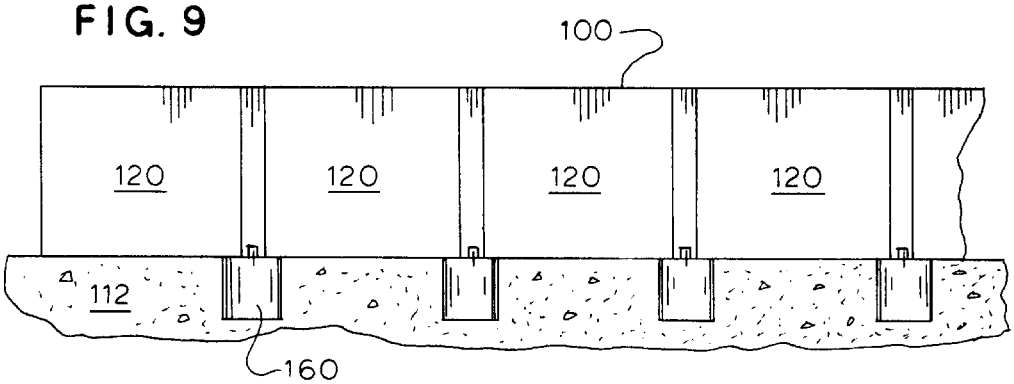
FIG. 9 depicts a front plan, partially sectioned view of noise abatement wall 100 mounted on a series of caissons 160.

In FIG. 9, a series of wall sections 120 are depicted as combined to form the noise abatement wall 100. These wall sections 120 are mounted on a series of caisson 160. With a view of FIG. 10, a bolting to the caisson 160 is shown.

Figure 11:
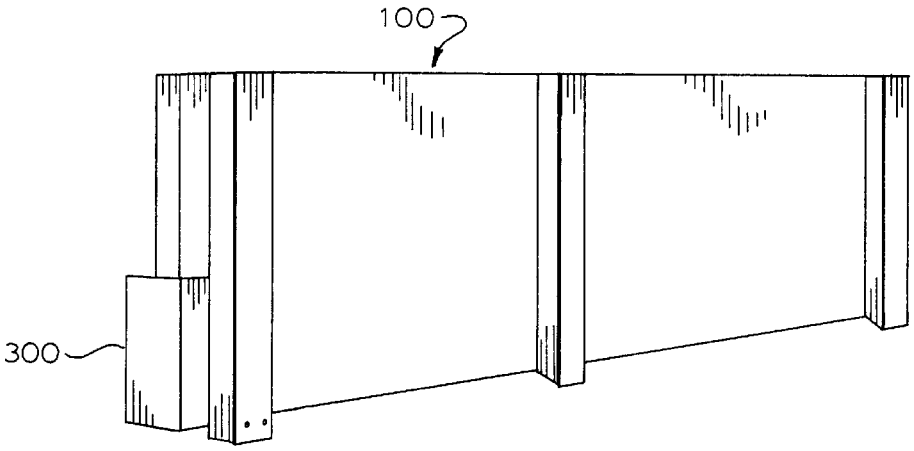
FIG. 11 depicts a front plan, partially sectioned view of noise abatement wall 100 mounted on a support or lower wall 300.

In FIGS. 11 and 12, the mounting of the wall sections 120 to the lower wall 300 is again shown. With the flange 302 mounted thereon, bolts 304 are inserted through the wall section 120 into the lower wall 300 thereby supporting the wall section 120 in place. With this structure a very sound noise abatement wall 100 is formed.

Figure 13:
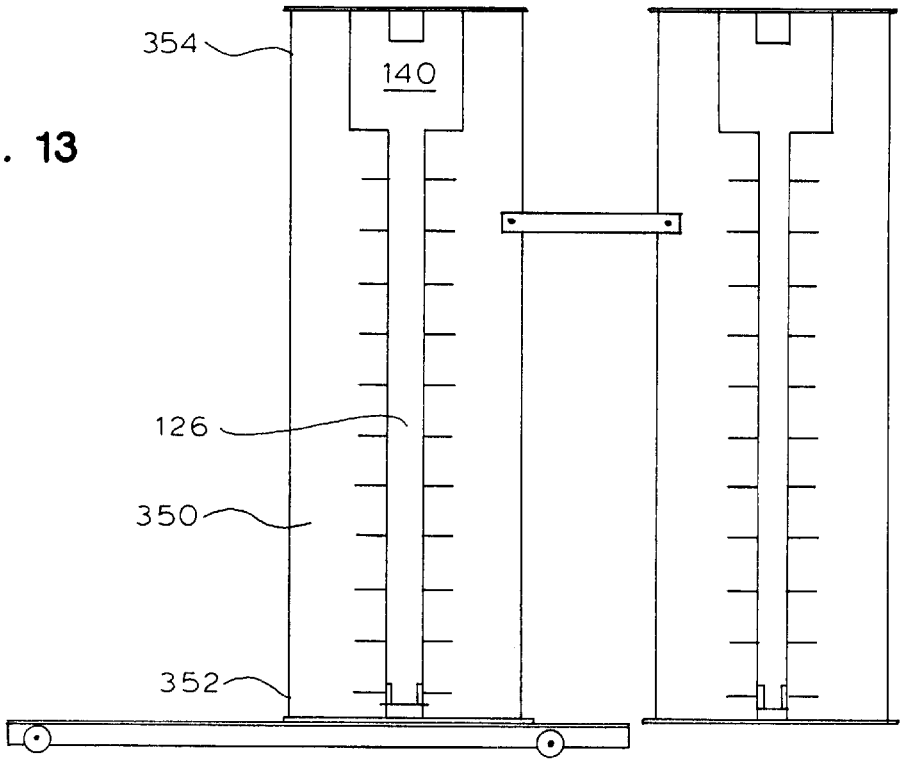
FIG. 13 depicts a perspective view of mold assembly 350 for wall section 120.
Figure 14:
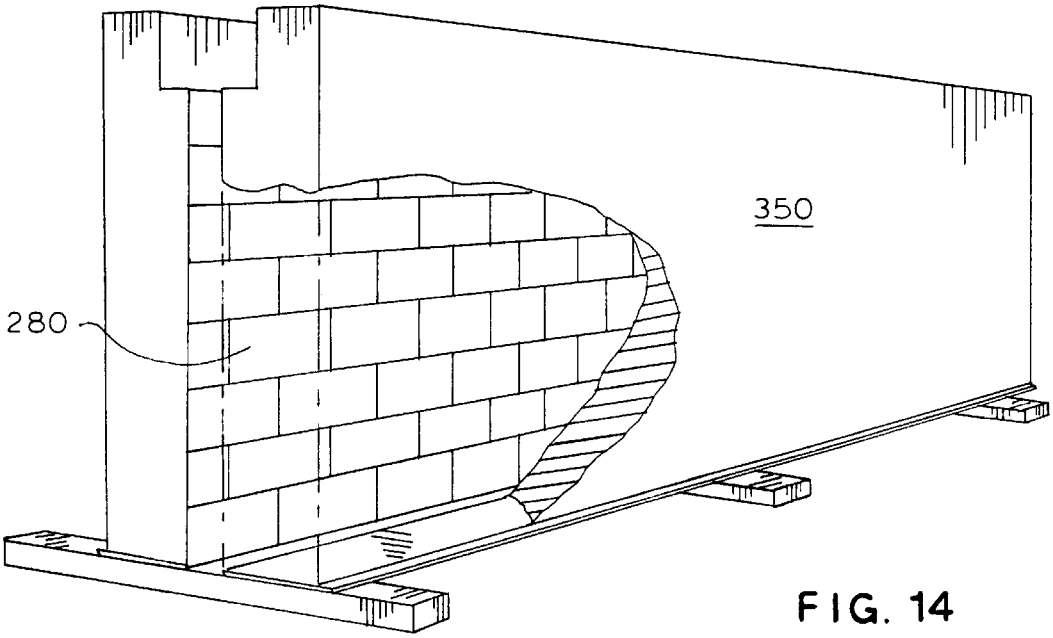
FIG. 14 depicts a perspective, partially cutaway view of mold assembly 350 for wall section 120.

FIG. 13 and FIG. 14 combine to show a structure of the mold 350. The base 352 of the mold 350 is relatively narrow in order to form the wall panel 126. The top 354 of the mold is wider in order to form mounting block 440, and to provide for easier filling of the mold with cement or another shapeable and hardenable material. This structure permits the mold 350 to be bolted or otherwise assembled easily.

Block surfaces 280 can be mounted within the mold 350 and have any certain shape thereon. This achieves the desired appearance of the wall section 120 with the desired design or noise abutment surface on wall panel 126. After the material has hardened, the wall section 120 is separated from the mold 350 and transported to a site for use in noise abatement wall 100.

This application—taken as a whose with the specification, claims, abstract, and drawings—provides sufficient information for a person having ordinary skill in the art to practice the invention disclosed and claimed herein. Any measures necessary to practice this invention are well within the skill of a person having ordinary skill in this art after that person has made a careful study of this disclosure.

Because of this disclosure and soley because of this disclosure, modification of this method and apparatus can become clear to a person having ordinary skill in this particular art. Such modifications are clearly covered by this disclosure.

What is claimed and sought to be protected by Letters Patent of the United States is:

1. A method for making a wall section having a mounting block and a panel for use in a noise abatement wall comprising:

a) providing a vertical mold assembly having a lower first section and an enlarged top section;

b) securing a reinforcing means within the vertical mold assembly;

c) adding a shapeable and hardenable material to the vertical mold assembly to form the wall section;

d) forming the panel of the wall section in the lower first section;

e) forming the mounting block of the wall section in the enlarged top section of the vertical mold assembly; and f) recovering the wall section.

2. The method of claim 1, further comprising:

a) providing a first surface for the vertical mold assembly to shape a first side of the panel;

b) providing a second surface for the vertical mold assembly to shape a second side of the panel; and c) disposing the first surface in opposition to the second surface; thus providing a shaped first side of the panel and a shaped second side of the panel.

3. The method of claim 2 further comprising:

a) providing a plurality of nut and bolt assemblies to assemble the vertical mold assembly;

b) providing concrete as the shapeable and hardenable material; and c) allowing the concrete to harden prior to recovering the wall section.

4. The method of claim 1 further comprising:

a) forming the panel with a post end at the mounting block;

b) forming the panel with a notch end oppositely disposed from the post end; and c) forming the mounting block with a receiving notch in the mounting block, the receiving notch being adapted to receive the notch end of a second panel of a second wall section.

5. The method of claim 4, further comprising:

a) securing the reinforcing means by providing at least one horizontal support rod and at least one vertical support rod to be secured in the wall section; and b) providing the at least one horizontal rod and the at least one vertical rod combining in order to provide strength and wind resistance for the wall section.

6. The method of claim 5 further comprising:

a) securing the at least one horizontal support rod and the at least one vertical support rod in the mounting block; and b) providing the reinforcing means with wire to be secured in the vertical mold assembly in order to reinforce the mounting block and the panel.

7. The method of claim 6 further comprising:

a) providing the vertical mold assembly with the reinforcing means so that the at least one horizontal support rod extends from the mounting block into the panel;

b) providing at least a first vertical support rod and at least a second vertical support rod for the reinforcing means;

c) mounting the at least one first vertical support rod in the panel; and d) mounting the at least second vertical support rod in the mounting block.

8. The method of claim 6 further comprising the at least one horizontal support rod and the at least one vertical support rod being positioned in the mounting block; and providing wire in the lower first section and the enlarged top section as a reinforcement of the wall section in addition to the at least one horizontal support rod and the at least one vertical support rod, the wire serving as reinforcement for the mounting block and the panel.

* * * * *